United States Patent [19]

Pfanstiel

[11] 4,299,207

[45] Nov. 10, 1981

[54] MASSAGE ARRANGEMENT

[76] Inventor: Erich Pfanstiel, Haus Nr. 3, D-7853 Steinen, Kirchhausen, Fed. Rep. of Germany

[21] Appl. No.: 120,854

[22] Filed: Feb. 11, 1980

[30] Foreign Application Priority Data

Feb. 13, 1979 [DE] Fed. Rep. of Germany ..... 2905383

[51] Int. Cl.[3] ..... A61H 7/00

[52] U.S. Cl. ..... 128/56

[58] Field of Search ..... 128/56, 57, 44, 24.2, 128/24.3, 25 R

[56] References Cited

U.S. PATENT DOCUMENTS

| | | | |
|---|---|---|---|
| 1,609,796 | 12/1926 | Cheney | 128/56 |
| 2,466,470 | 4/1949 | Norris | 128/57 |
| 2,819,714 | 1/1958 | London | 128/57 |
| 3,862,459 | 1/1975 | Brunette | 128/56 X |
| 4,040,132 | 8/1977 | Braun | 128/56 X |

*Primary Examiner*—John D. Yasko

*Attorney, Agent, or Firm*—Michael J. Striker

[57] ABSTRACT

A massage arrangement includes a frame positioned against a vertical wall and a plurality of massage rollers to apply a massaging force to a body to be massaged. This body is located in a substantially vertical position between lateral sides of the frame. The frame is slanted and supported by a resilient member mounted between the wall and the upper end of the frame. The resilient member generates a force which yieldably supports the frame so the massage rollers may yield in direction away from the body to be massaged upon the advancing movement of the massage rollers in contact with the projecting parts of the human body.

19 Claims, 2 Drawing Figures

MASSAGE ARRANGEMENT

BACKGROUND OF THE INVENTION

The invention relates to the massage arrangements mounted on a frame positioned against a vertical wall and including a plurality of massaging rollers to apply a massaging action to a vertically disposed human body.

In many conventional massage devices a frame carrying massage rollers is positioned substantially vertical and the massaging rollers are movable up and down with respect to a standing person. It has been found disadvantageous that in the known devices upon the movement of the massage rollers some of the projecting parts of the human body are subjected to undesirably strong massage forces. In such cases a comfortable massage with an even distribution of the massaging forces is difficult or impossible.

SUMMARY OF THE INVENTION

It is an object of the present invention to provide an improved massage device with automatic adjustment of the massage rollers to avoid the non-uniform application of massage forces to a body to be massaged, so that a person may stay in a once assumed position during the whole massaging process rather than having to move to avoid excessive application of force to certain body parts.

Another object of the present invention is to provide a massage arrangement which is easy to operate and comfortable in use.

These and other objects of the present invention are achieved by so mounting the frame carrying the massage rollers of a massage device that it can yieldingly recede away from the body being massaged, as the rollers move along the length of the body. These adjusting means may include a flexible support mounted on an upper end of the frame. When the rollers encounter a projecting part of the body (e.g., the buttocks) they can thus recede against a biasing force and this results in the application of substantially uniform massaging forces to all parts of the human body.

It has been found advantageous to rigidly fix one end of the frame carrying the massage rollers and to pivotally support the other end of the frame by means of a resilient support member. The massage rollers are positioned to be movable along the frame through a path corresponding to the countour lines of the body to be massaged; this movement occurs together with the frame, which is slanted. The massaging rollers are pivotally mounted and are automatically adjusted in accordance with different contours of the body which they contact during the massaging. A gravity of spring force or the like may be provided to adjust the position of the frame with the rollers with respect to the body.

The resilient support acts in such a manner, that the frame can yieldingly recede away from the body being massaged. The massage rollers in their movement along the human body assist the restoring force of the flexible support to adjust the frame with the rollers with respect to the body. In a slanted position the frame itself adjusts its own position relative to the body being massaged due to its weight acting to yieldably support the frame.

The frame may be provided with a support surface, as for example with a base which is pivotally supported thereto. The frame may be slanted in the vertical direction and is supsended from the wall at its upper end by means of flexible pulling elements connected to the wall so that the distance between the frame and the wall is gradually increased in the direction from below towards above. The flexible pulling element may be a rubber strip, a spring or a pneumatic cylinder actuating a telescope arrangement mounted between the wall and the uppermost end of the frame.

An additional flexible pulling element may be provided in the arrangement of the foregoing type in case the first flexible element slackens in its initial position or is broken in order to ensure the reliable operation of the massage arrangement. In case this happens, the second flexible element assists the frame to remain in its balanced position so that the frame with the relatively heavy massage rollers will not fall over. The support surface or the base mounted on the lowermost end of the frame may be formed with an opening which receives a pin to fix the frame, as for example to the floor. The base may be formed as a bent portion of the frame.

Contact rollers may be arranged in the device with their axles parallel to the axis of the massage rollers. The contact rollers are adapted to roll on the surface to be massaged so as to automatically adjust the massage rollers. This is particularly advantageous if the elements of the massage rollers are compressed and do not properly translate the whole massaging force onto the elevated parts of the human body. The contact rollers may also be used as massage rollers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
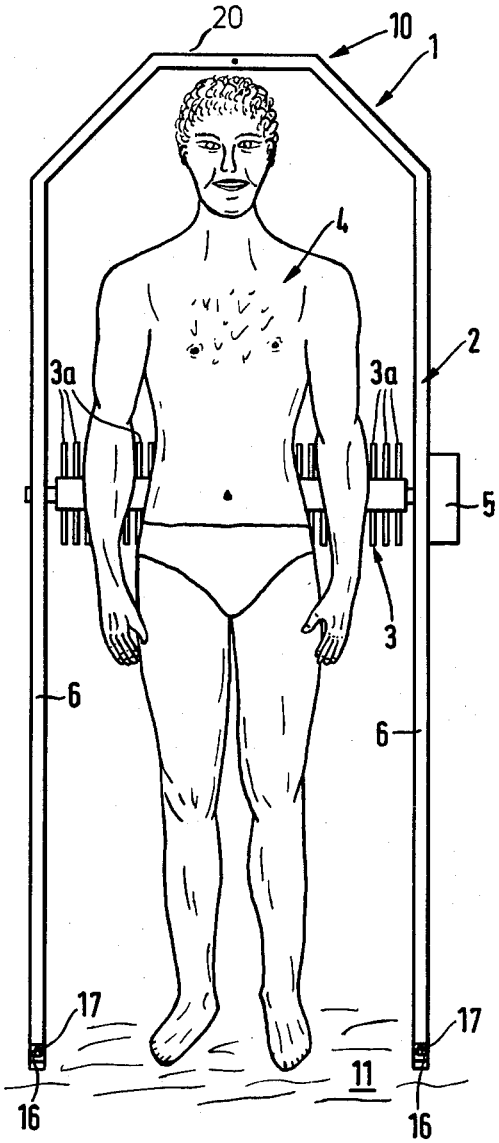
FIG. 1 is a front elevation view of the massage device in accordance with the present invention.

Referring to the drawings, a massage device 1 includes a frame 2 including a pair of lateral elongated sides 6 and a substantially horizontal part 20. The length at the frame exceeds the height of body 4 to be massaged. Massage rollers 3 are mounted on the frame and adapted to rotate about their axis with the aid of a drive arrangement 5. Massage rollers 3 are mounted on the frame to be advanced up and down along the length of the longitudinal sides 6 in order to provide the massaging action for the whole human body. This advancing movement may be achieved by any conventional means for linear movement, as for example, by means of rails.

A person to be massaged stands between lateral sides 6 beneath horizontal part 20. The frame 2 with massage rollers 3 may move against a counteracting force exerted on the massage rollers during operation. As the massage rollers move up in contact with the projecting uppermost parts of the human body, the massage rollers need to be adjusted to be in constant contact with the body to be massaged. The purpose of the adjustment is to provide an evenly distributed massaging action without changing the body's position during operation.

Each lateral side 6 of the frame 2 is provided with a lower portion 9 which is pivotally supported on the frame whereas an upper portion 10 of frame 2 is resiliently supported on a wall 12 against which the massage arrangement is positioned.

End portions 9 may be formed with guide rails to provide a pivoting movement of the end portions of the frame so that both upper portions 10 and lower portions 9 of the frame will be adapted to be movable against a counteracting force. In the preferred embodiment lower portions 9 of sides 6 are pivotally supported with respect to the frame. The frame may be supported in its intermediate part.

A flexible support 13 is arranged at the upper end of the frame 2 to resiliently connect the upper end 10 to the wall 12. This support constitutes a spring force acting to adjust the position of the frame relative to the body. The surfaces to be massaged are located within the lateral sides 6 of frame 2 and the massage action is oriented in direction of the weight of the frame.

Figure 2:
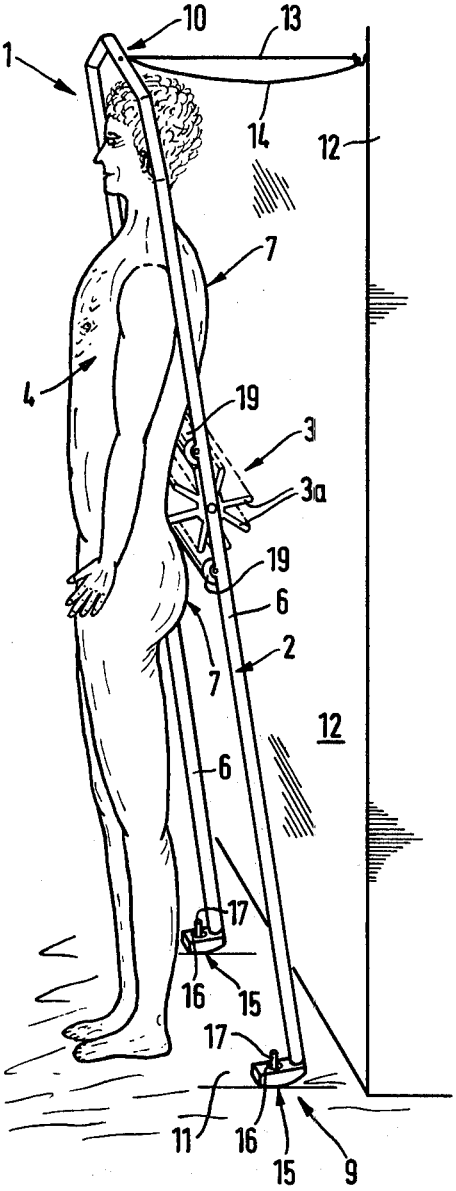
FIG. 2 is a side elvational view of FIG. 1.

The frame 2 is disposed on a base 11 to which it is pivotally secured. Frame 2 is slanted and suspended from wall 12 as was mentioned above. As seen in FIG. 2, the distance between wall 12 and slanted frame 2 is increased in the direction from below towards above. The flexible support 13 may be formed as a rubber strip, a spring or a pneumatic device provided with a telescopic arrangement positioned between wall 12 and frame 2. In order to prevent injury and/or damage in case the flexible support 13 slackens or snaps, a second support element designated 14 is provided in the device extending between wall 12 and the upper end 10 of the frame 2. In case the support element is broken as a result of overloading or wear, frame 2 will not fall under its own weight since this is prvented by the second flexible element 14. The flexible element 14 may be formed as a chain.

Base 11 may be provided with rails or a hinge joint to support the lower ends 9 of the frame. The end portions 9 include lower elements 15 with rounded surfaces and an opening 16 formed therein. A fixing pin 17 is inserted into the opening 16 to fix the lower ends of sides 6 to base 11, which may be a floor. Elements 15 may be formed integrally with lateral sides 6 as bent portions thereof or may be welded thereto. A clearance provided between the opening 16 and pin 17 permits a sufficient tilting movement of portions 15 and at the same time provides a reliable connection of the frame to base 11.

As shown in FIG. 2, guiding rollers 19 may be mounted on the lateral sides 6 of the frame, which are arranged to be oriented against the surfaces to be massaged so as to adjust the massaging rollers in their contact with the human body. The massaging rollers are normally flexible. Upon the movement of the massaging rollers along the human body the rollers may be squeezed in contact with the projecting uppermost parts of the human body and in these circumstances the massaging force proivded by the rollers is not sufficient to pivot the frame away from the body. The contact rollers which are not flexible or slightly flexible serve to adjust the position of the massage rollers with respect ot the human body by rotating about their axes and moving in constant contact along the body due to the advancing movement of the massage rollers. The contact rollers may be used as massage rollers.

A person to be massaged stands within the frame 2 and during the massaging process need not move to adjust his or her position with respect to the massaging rollers. All the adjustment in this arrangement is obtained automatically, so that the person may assume and remain in a relaxed stance. Pressure is generated by the massaging rollers due to the weight of the arrangement but lessened by the action of flexible support 13. When the pressure on the human body is increased upon the advancing movement of the massage rollers an additional force is added to the restoring force and the frame with the massage rollers yields.

It will be understood that each of the elements described above, or two or more together, may also find a useful application in other types of constructions differing from the types described above.

While the invention has been illustrated and described as embodied in a massage arrangement, it is not intended to be limited to the details shown, since various modifications and structural changes may be made without departing in any way from the spirit of the present invention.

Without further analysis, the foregoing will so fully reveal the gist of the present invention that others can, by applying current knownledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A massage arrangement, comprising a frame positioned on a stationary base; massage rollers mounted on said frame for advancing movement along the length of said frame to apply a massaging action to a substantially vertically positioned body to be massaged; said frame being slanted with respect to a vertical wall and being hingedly mounted in said stationary base; and means suspended from an upper end of said frame and yieldably supporting said frame so that the frame and rollers may yield in direction away from the body upon contact of the rollers with any projecting part of the body.

2. The massage arrangement of claim 1, wherein said frame includes a pair of lateral elongated portions and a substantially horizontal portion connected to said elongated portions.

3. The massage arrangement of claim 1, wherein said means comprise a flexible element to resiliently support said frame against said vertical wall, said flexible element being connected to said horizontal portion of said frame.

4. The massage arrangement of claim 3, wherein each lateral elongated portion is provided with a lower part, said lower part being pivotally mounted on said stationary base.

5. The massage arrangement of claim 4, wherein said lower parts of said elongated portions are adjustable.

6. The massage arrangement of claim 3, wherein said flexible element is adjustable.

7. The massage arrangement of claim 6, wherein said flexible element is connected to said vertical wall.

8. The massage arrangement of claim 7, wherein the distance between said wall and said frame in its slanted position is substantially increased from below towards said upper end of said frame.

9. The massage arrangement of claim 8, wherein said flexible element is a rubber strip.

10. The massage arrangement of claim 8, wherein said flexible element is a spring.

11. The massage arrangement of claim 8, wherein said flexible element is a telescopic arrangement connected to said wall and said frame.

12. The massage arrangement of claim 11, wherein said telescopic arrangement is operatively connected to a pneumatic device to actuate said telescopic arrangement.

13. The massage arrangement of claim 8, wherein a support element is provided in the arrangement, said support element being mounted between said wall and said frame and being operative when said flexible element is slackened or broken up.

14. The massage arrangement of claim 4, wherein said lower part of said elongated portion includes an end member formed with an opening therein, and a fasten pin is provided inserted into said opening to connect said end member to said stationary base.

15. The massage arrangement of claim 14, wherein said end member is formed with rounded lowermost surfaces.

16. The massage arrangement of claim 15, wherein said end member is a bent integral portion of said lateral elongated side of said frame.

17. The massage arrangement of claim 15, wherein said end member is a supplementary element welded to said lateral elongated side of said frame.

18. The massage arrangement of claim 8, further comprising contact rollers, adapted to move against the surfaces of the body to be massaged and operatively connected to said massage rollers so as said massage rollers are automatically adjusted relatively to the body.

19. The massage arrangement of claim 18, wherein said contact rollers are additional massage rollers.

* * * * *